United States Patent [19]

Dlugopolski

[11] Patent Number: 4,560,102

[45] Date of Patent: Dec. 24, 1985

[54] REVERSIBLE FOLDER AND ROUND TRIP MAILER BOX

[75] Inventor: Joseph Dlugopolski, Lombard, Ill.

[73] Assignee: Fidelity Container Corporation, Elk Grove Village, Ill.

[21] Appl. No.: 645,539

[22] Filed: Aug. 30, 1984

Related U.S. Application Data

[63] Continuation of Ser. No. 423,610, Sep. 27, 1982, abandoned.

[51] Int. Cl.[4] ..... B65D 85/00

[52] U.S. Cl. ..... 229/40; 206/424; 206/459; 206/521

[58] Field of Search ..... 229/40, 87 R, 31 R, 229/33, 36, 34 HW; 206/424, 459, 521

[56] References Cited

U.S. PATENT DOCUMENTS

| | | | |
|---|---|---|---|
| 2,011,703 | 8/1935 | Barker | 229/87 R |
| 2,448,679 | 9/1948 | Meinhardt | 229/34 HW |
| 2,493,176 | 1/1950 | Whitehead | 229/33 |
| 2,608,340 | 8/1952 | Donnell | 229/33 |
| 2,792,981 | 5/1957 | Grammer | 229/40 X |
| 3,368,735 | 2/1968 | Levi | 229/40 |
| 3,386,642 | 6/1968 | Young | 206/424 X |
| 3,399,821 | 9/1968 | Ringholz | 229/40 |
| 3,445,054 | 5/1969 | Champlin | 229/40 |
| 3,790,065 | 2/1974 | Carpenter | 206/424 X |
| 3,861,580 | 1/1975 | Sieffert | 229/40 |
| 4,046,311 | 9/1977 | Voytko | 229/40 |
| 4,090,607 | 5/1978 | McCall | 229/40 X |

FOREIGN PATENT DOCUMENTS

| | | | |
|---|---|---|---|
| 234683 | 7/1961 | Australia | 229/31 R |

*Primary Examiner*—William T. Dixson, Jr.
*Assistant Examiner*—Gary E. Elkins
*Attorney, Agent, or Firm*—Laff, Whitesel, Conte & Saret

[57] ABSTRACT

A round trip mailer box is formed from a unitary corrugated cardboard blank with a plurality of scored lines for a quick and easy folding of panels to set up the box. The corners of the box are reinforced and strengthened by folding and bracing corner panels. The folding of the box is completed by inserting tabs on two interchangeable and overlapping top panels, one over the other, into cutouts on opposite sides of the box. These overlapping top panels can be interchanged so that when a mailing label is placed on each top panel, the box can be mailed to a recipient and later remailed back to the sender by simply interchanging the relative positions of the top panels. The box is easily secured in its closed position by taping or other closure means at the two inserted end tabs of the box and is easily opened, reclosed and reused.

11 Claims, 9 Drawing Figures

REVERSIBLE FOLDER AND ROUND TRIP MAILER BOX

This is a continuation of application Ser. No. 423,610, filed Sept. 27, 1982, now abandoned.

This invention relates to boxes for packaging and mailing goods, and more particularly, to such boxes which are not appreciably damaged by normal use and which can easily be returned to the sender for reuse, without having to readdress the box.

The inventive box is designed to provide a sturdy, convenient round trip mailer which can easily be mailed back and forth between buyer and seller or lender and borrower. The term "mail" herein includes all suitable forms of package transportation and delivery. It will be convenient to refer to these boxes as being particularly designed for film cannisters or record albums, by way of example. However, the invention is equally applicable to any of many other similar goods and products, and especially to those types of goods which are delivered by mail to a recipient and later returned to the sender by mail. Also, the box is strengthened and reinforced at the corners to stand up to the rigorous handling of mail and parcels.

Goods such as movie films or record albums are often sold or loaned by libraries or other similar services or businesses to borrowers, who may request delivery of the film or album by mail. These goods are then shipped in their cannisters or containers to the buyer or borrower, often with an agreement that they will be returned to the library or owner within a specified period of time. Similarly, mail-order goods such as clothing or other catalog items are often shipped to purchasers with agreements that they may be returned if unsuitable to the purchasers.

Therefore, round trip boxes are desirable for shipping goods and for enabling the recipient of such goods to return them to the original shipper when necessary.

Conventional boxes for mailing goods often do not enable a reuse of the boxes. After these boxes are shipped for the first time, they are torn, crushed or damaged, so that their reuse is undesirable and, perhaps, impossible. Sometimes, these boxes are damaged because the recipient cannot open the box without damaging, destroying, or tearing it.

Another problem with conventional round trip mailer boxes is that they should contain both the sender's and the recipient's address when sent and received. However, one or the other of the addresses must be obliterated or covered before the box is shipped, and yet that one address must remain available for the next leg of the round trip. Thus, the borrower or purchaser of goods in such boxes may find it difficult or inconvenient to remove or cover the first address, before returning the goods in the box. If two addresses are not on the box when first sent, the borrower or purchaser must take the time to relabel the box so that it will be returned promptly to the lender or seller. Of course, he may make a mistake in the address and the goods might then be lost.

Accordingly, an object of the invention is to provide new and improved packaging and mailing boxes, and particularly, to provide round trip boxes for shipping goods which will later be returned or reshipped in the original box. More particularly, an object is to provide boxes which will enable a mailing of goods to two different destinations without requiring any relabeling or readdressing of the boxes.

Here, an object of the invention is to provide mailing boxes with two overlapping top panels, with room on each panel for the placement of a label or address, so that when the box is fully closed only one label or panel is showing, depending on which overlapping panel is on the top. Thus, an interchanging of the positions of the top panels over one another, changes the label or address and enables an easy return of the box to its sender.

Another object of the invention is to provide easy-to-assemble boxes which may be set up with minimum effort, which can be secured in a closed position, and which may be opened easily and conveniently with little or no damage to the box. Yet another object is to provide sturdy, reinforced boxes which withstand rigorous handling by a shipping service or mail.

In keeping with one aspect of this invention, a round trip box is formed from a unitary corrugated cardboard blank having a plurality of scored lines which enable a quick and easy folding of panels to set up the box. The corners of the box are formed by panels which fold in a manner that reinforces and strengthens the box corners. The folding of the box is completed by inserting tabs on the two overlapping top panels, one over the other, into cutouts on opposite sides of the box. The overlapping relationship of the two top panels can be interchanged so that when a mailing label is placed on each top panel, the box can be mailed to a recipient and later remailed back to the sender by simply interchanging the relative positions of the top panels. The desired labeled panel is placed over and covering the other undesired labeled panel. Regardless of which label is exposed to view, the box is easily secured in its closed position by taping or other closure means at the two inserted end tabs of the box and, thus, is easily opened, reclosed, and reused.

The invention will be best understood by reference to the following description of an embodiment of the invention taken in conjunction with the accompanying drawings in which.

Figure 1:
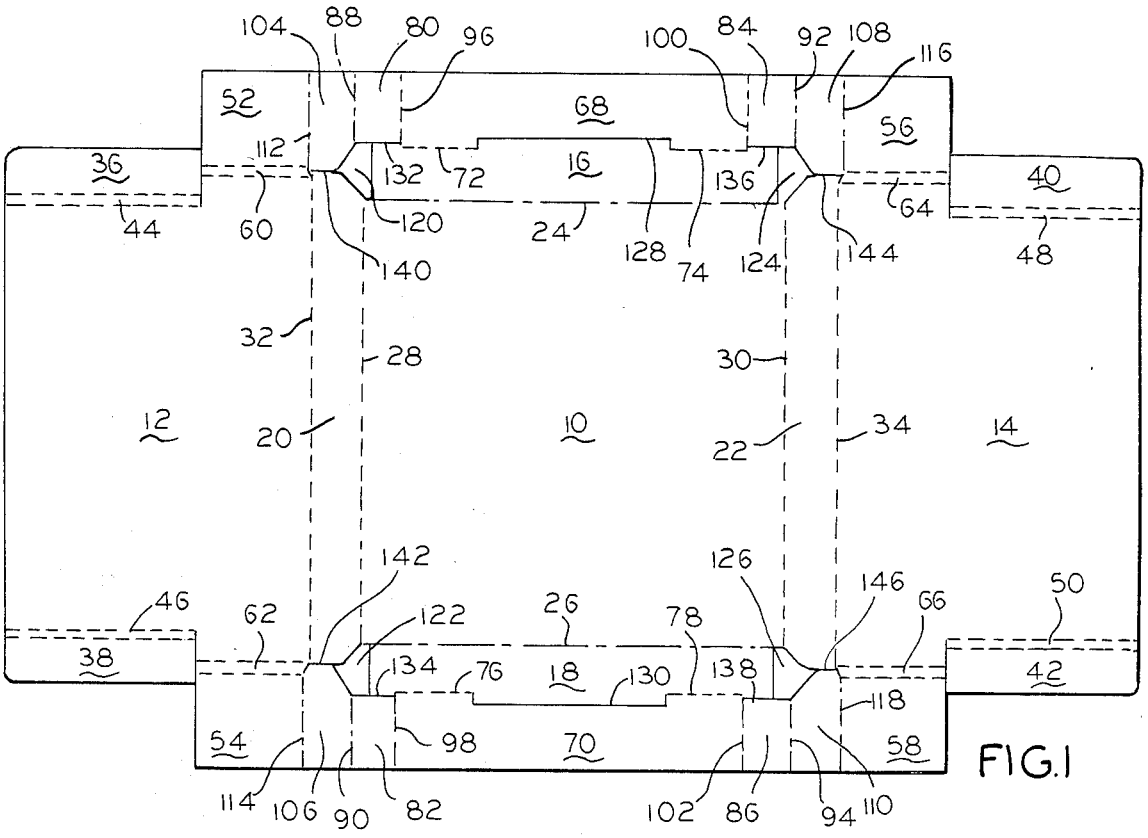
FIG. 1 is a plan view of a blank for the unfolded box.

As best shown in FIG. 1, a reversible folder, round trip mailer box, constructed in accordance with the teachings of this invention, comprises a bottom panel 10, two top panels 12, 14 and four side panels 16, 18, 20, 22.

In FIG. 1, dashed lines are used to indicate where scoring forms fold lines and solid lines are used to indicate where blank cutting occurs. Dot-dashed lines indicate where a semi-piercing rule die is used to form an alternating cut and score line, as at 24, 26. Non-cutting rule dies form score lines where indicated by dashed lines (e.g. line 28), and cutting rule dies cut through the blank where indicated by solid lines, as at point 120, for example.

The bottom panel 10 is defined by semi-pierced lines 24, 26, and score lines 28, 30. The top panels 12, 14 begin at scored lines 32, 34 respectively, and include at each of their opposite ends insert tabs 36, 38, 40, 42 defined by double scored lines 44, 46, 48, 50. The top panels 12, 14 also include folding corner panels 52, 54, 56, 58 defined by double score lines 60, 62, 64, 66. The width of each top panel 12, 14 is substantially greater than one-half of the width of the bottom panel 10, so that top panels 12, 14 overlap each other when the box is closed.

The side panels 16, 18 are defined by semi-pierced lines 24, 26, and by score lines 72, 74, 76, 78, by the cutouts 120, 122, 124, 126, and by cut lines 128–138. Folding end panels 68, 70 are defined by scored lines 72, 74, 76, 78, by semi-pierced lines 88, 90, 92, 94 and by the cut lines 128–138. Bracing corner panels 80, 82, 84, 86 are defined by semi-pierced lines 88–94, by scored lines 96–102, by cutouts 120–126 and by cut lines 132–138. These corner panels 80, 82, 84, 86, fold to assume diagonal positions (FIG. 9) and provide corner bracing.

The side panels 20, 22 are defined by scored lines 28, 30, 32, 34 and include folding corner panels 104, 106, 108, 110, defined by semi-pierced lines 88–94, and by semi-pierced lines 112–118.

Cutouts are formed at points 120–126 to remove unnecessary bulk. Cut lines are made at points 128–146. The cut lines 128, 130, enable an insertion of tabs 36–42 for securing of the top panels 12, 14 into position when the box is closed. The various cut line and cutout openings also reduce binding where the folding cardboard would otherwise form undue bulk, bind or prevent smooth folds.

As shown in FIGS. 2–5, to fold the box, the side panels 16, 18 are first folded upwardly and out of the plane of the paper at lines 24, 26. This folding causes the end panels 68, 70, corner panels 52–58, 80–86, and 104–110 to also fold up out of the plane of the paper.

Means are provided for enabling strengthened and reinforced corners of the box to stand up to rigorous mail handling so that the box can be used and reused. The corners of the box are formed by folded side and end panels of the box to provide box corners which have at least double the amount of layered cardboard at the corners with one layer set at a diagonal for corner bracing.

In greater detail, the end panels 68, 70 are folded over at lines 72–78 so that end panels 68, 70 are parallel to and spaced away from the bottom panel 10. This folding initially causes folding corner panels 52, 54, 56, 58 to lie almost flat against the top panels 12, 14. The bracing panels 80–86 meet the side panels 20, 22 at approximately a thirty to forty-five degree angle, as the semi-pierced lines 88–94 meet or lie almost flat against scored lines 28, 30. The folding corner panels 104–110 fold down toward and lie flat against the side panels 20, 22 as the semi-pierced lines 112–118 lie against the scored lines 32, 34.

Figure 2:
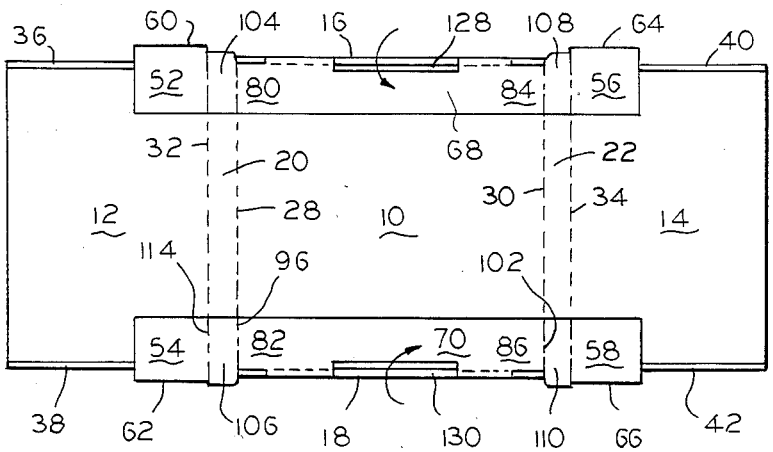
FIG. 2 is a plan view of the partially folded box in an open position.

As shown in FIG. 2, the insert tabs 36, 38, 40, 42 are folded up and out of the plane of the paper in FIG. 1, at double scored lines 44, 46, 48, 50.

Figure 3:
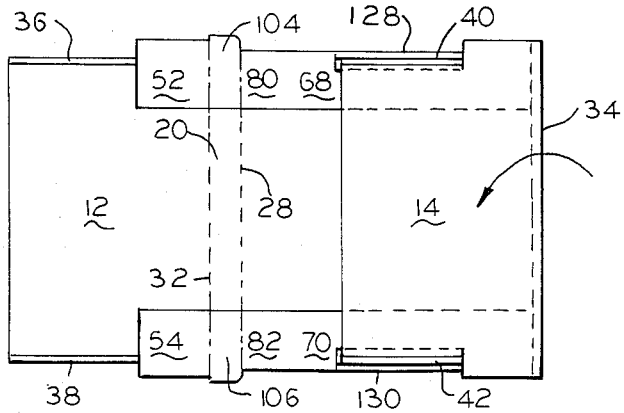
FIG. 3 is a plan view of the partially folded box in a semi-closed position.

FIG. 3 shows the box when the side panel 22 and the right hand top panel 14 are folded up out of the plane of the paper at scored line 30. The top panel 14 is then folded down toward the bottom panel 10 at scored line 34. The insert tabs 40, 42 are inserted into the cutouts 128, 130. This partial closure of the box causes the corner panels 108, 110 to lie flat against the side panels 20, 22, and the scored lines 92, 94 line up with and meet the scored line 30 to form reinforced corners of the box.

When the top panel 14 of the box is closed as shown in FIG. 3, the bracing corner panels 84, 86 form approximately thirty to forty-five degree angles with the side panel 22 and the corner panels 108, 110 lie flat against the side panel 22.

Figure 4:
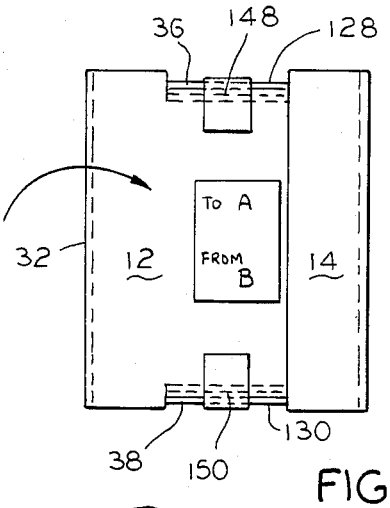
FIG. 4 is a plan view of the folded box in a closed position which shows a left hand top panel placed over and concealing a right hand top panel.

FIG. 4 shows the completely folded box with the side panel 20 and the left hand top panel 12 folded up out of the plane of the paper at scored line 28 and folded down at scored line 32 and over the right hand top panel 14. The insert tabs 36, 38 are inserted over the insert tabs 40, 42 and into the cutouts 128, 130. As explained previously, this completed folding of the box creates reinforced corners when corner panels 104, 106 lie flat against the side panel 20, and corner panels 80, 82 form approximately thirty to forty-five degree bracing angles with respect to the side panel 20.

Figure 5:
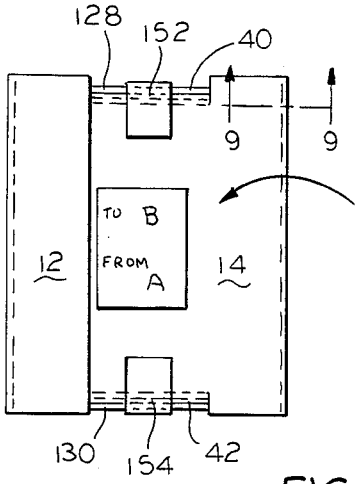
FIG. 5 is a plan view of the folded box in a closed position which shows a right hand top panel interchanged with and covering the left hand top panel of FIG. 4.

Means are also provided for enabling the positions of two top panels to be interchanged so that labels can be placed on each panel for mailing to a recipient and back to the sender, by interchanging the positions of the top panels, in order to place a selected one of the panels over the other. More particularly, as shown in FIGS. 4 and 5, the positions of top panels 12, 14 are interchanged easily and conveniently merely by folding top panel 12 over top panel 14 as in FIG. 4 or vice-versa as in FIG. 5. Therefore, if top panel 12 is labeled with A's address and top panel 14 is labeled with B's address, the box can be shipped from B to A as in FIG. 4, by simply folding and inserting top panel 12 over top panel 14. When A wishes to return the box to B, he simply folds top panel 14 over top panel 12, and the return address for the box is displayed, in order to return it to the original sender B, with no readdressing or relabeling.

Means are also provided for securing the box in a closed position so that the box can be easily opened and reused without damage to the box.

More specifically, FIGS. 4 and 5 show the simple closure of the box by taping or plastic strapping 148, 150 at the points of insertion of the insert tabs 36, 38, 40, 42, in the cutouts 128, 130. When the box is reused, as in FIG. 5, fresh tape or plastic strapping 152, 154 replaces the old, cut tape or strapping 148, 150.

Figure 6:
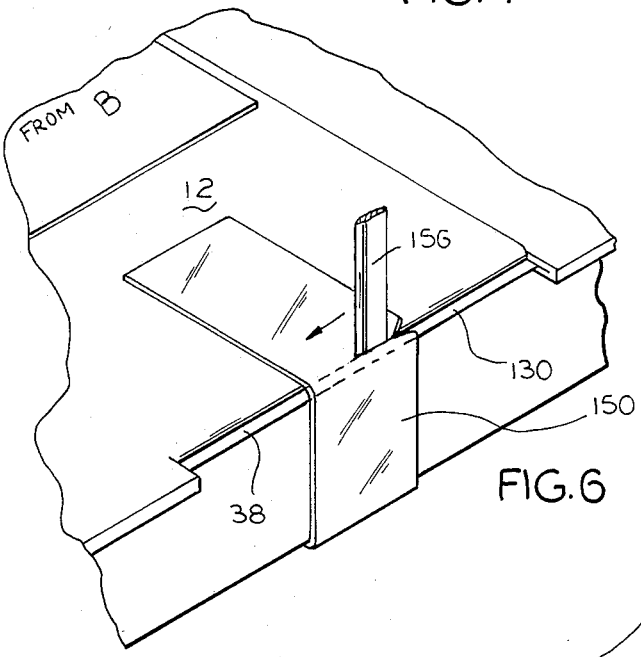
FIG. 6 is a perspective view of the top panel of FIG. 4, which shows the tape that secures the box in a folded position for mailing, and a knife, letter opener or similar device cutting the tape for opening the box.

FIG. 6 shows the simple manner of opening of the box by using a knife, letter opener, or the like 156 to cut the tape or strapping 150. Since the knife or letter opener 156 is only used in the space between the tucked in tabs 36–42 and the cutouts 128, 130, there should be no damage to the box, when cutting the tape.

Figure 7:
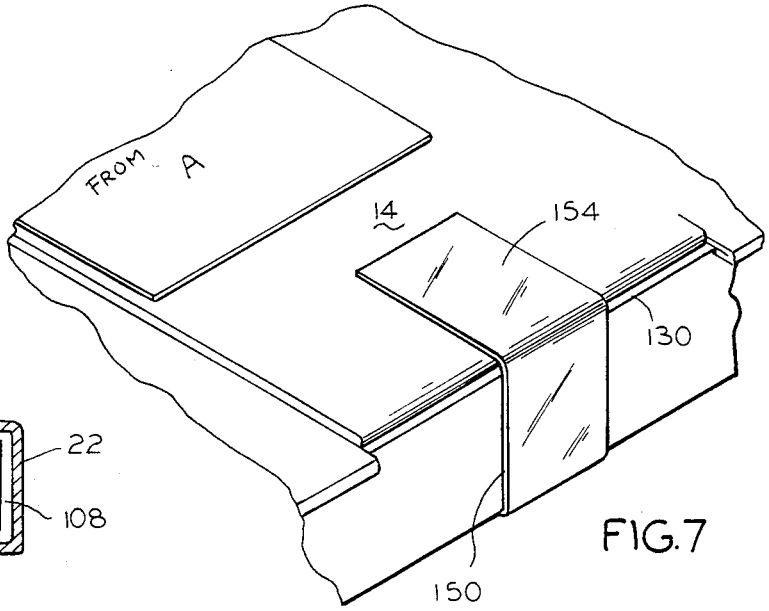
FIG. 7 is a perspective view of the top panel of FIG. 5 which shows the tape applied for resecuring and remailing the box after the tape in FIG. 6 has been cut and the positions of the top panels have been interchanged to display a second address.

FIG. 7 shows the fresh tape or strapping 154 which is used after the position of top panel 14 is interchanged with and folded over the top panel 12 when the box is reused as in FIG. 5.

Figure 8:
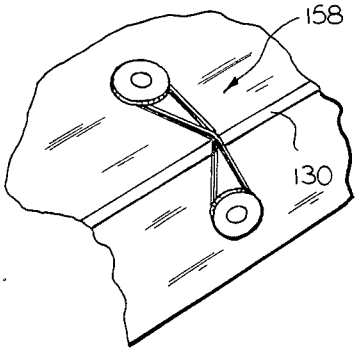
FIG. 8 shows an alternative means for securing the closed box when tape is not used.

As shown in FIG. 8, alternative means 158 for closing the box may be used to eliminate the need for both the tape and cutting the tape. Here a string or cord is wrapped around two buttons made of any suitable material such as cardboard, plastic, fiberous material, metal, or the like. The closure means 158 enables easy opening and reusing of the box by unwinding and rewinding the string.

Figure 9:
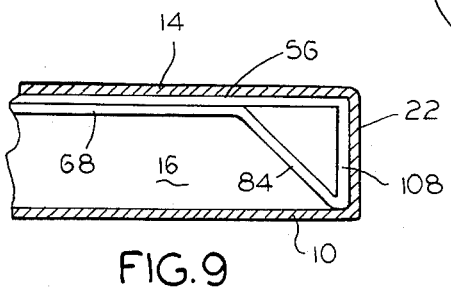
FIG. 9 is a cross-sectional view of one of the corners of the inventive box taken along line 9—9 of FIG. 5.

FIG. 9 shows a cross-sectional view of one of the reinforced corners of the box taken along line 9—9 of FIG. 5. The double layered sides of the corner are formed where top panel 14 lies next to corner panel 56 and where side panel 22 lies next to corner panel 108. Bracing corner panel 84 forms an approximately thirty to forty-five degree angle between the side panel 22 and the bottom panel 10 which also strengthens and reinforces the corner of the box.

The many advantages of this folder mailer box should now be apparent. First, the interchangeable top panels enable easy, convenient mailing of the same reusable box back and forth between a recipient and a sender, without requiring a readdressing of the box. Second, the box is reinforced and strengthened by unique folding corner panels which provide double thickness along with angular corner bracing reinforcement at each of the four corners of the box. Third, the box will stand up to rigorous handling. Fourth, the securing of the closed box is made at two places in a manner which enables easy reopening with little damage to the box. Of course, there are still other advantages which will be apparent to those skilled in the art.

While the principles of the invention have been described above in connection with specific apparatus and applications, it is to be understood that this description is made only by way of example and not as a limitation on the scope of the invention, and the claims are intended to cover all equivalents.

I claim:

1. A round trip box made from a unitary blank having at least a bottom panel with four edges, four side panels positioned adjacent to and individually associated with said four edges, each of said edges and its individually associated side panel having the same length, a pair of top panels coupled to opposite ones of said side panels, a pair of end panels coupled to the other ones of said side panels, said unitary blank further having first, second and third side-by-side corner panels in each of the corners adjacent each adjoining pair of side panels, said first panel in each of said corners being attached to one of said top panels, said third of said panels being attached to one of said end panels, said third of said corner panels automatically forming a bracing panel responsive to a folding of said blank, said bracing panel being set at an angle by said folding in order to strengthen the corner when said blank is in a box configuration, each of said top panels having a width which is substantially greater than one-half of the width of the bottom, whereby said top panels overlap each other near the center of the box, and means for displaying an address on each of said top panels in the area of said overlap, whereby the addresses may be changed by reversing the overlapped positions of said two panels.

2. The box of claim 1 and a pair of insert tabs formed on opposite ends of each of said top panels, each of said side panels including cutout areas having dimensions for receiving said insert tabs formed on each of said top panels, said cutout areas and insert tabs forming cooperating means which enable said box to be sealed in a reusable manner.

3. The box of claim 2 wherein said cooperating means further comprises tape sealed across said top and side panels.

4. The box of claim 2 wherein said cooperating means further comprises a string and button combination for tying said top panel to said side panel.

5. The box of claim 1 wherein said bracing panels have dimensions which automatically causes them to come to rest in a position which is set at approximately thirty to forty-five degree angles between said side panels and said bottom panel of said box.

6. A method of making and folding the blank of claim 1 to form a reversible folder box, said method comprising at least the following steps:

a. forming said unitary blank into side, top, corner and bottom panels;

b. folding said unitary blank to cause said corner panels to self-articulate and to form double-sided and braced corners of said box responsive to further folding of said side and top panels, said panels automatically coming into place at the end of said folding with projecting tabs which protect the corners of the box ends;

c. interchangeably overlapping said pair of top panels on said unitary blank, each of said top panels having associated insert tabs at each of their opposite ends;

d. closing said box by folding a first of said two interchangeable panels and inserting said insert tabs associated therewith into cutouts in said other side panels of said box and then folding a second of said interchangeable panels over said first panel and inserting said insert tabs associated therewith into said cutouts; and e. placing labels in the overlapped areas on each of said interchangeable panels so that only one of said labels can be seen when said box is fully closed.

7. The method of claim 6 and the added steps of:

(e) transporting and delivering said box in a first leg of a round trip with one of said top panels exposing the label on it; and (f) transporting and delivering said box in a second leg of said round trip with the other of said top panels exposing the label on it.

8. A corner construction for a box formed from a unitary blank, said blank having at least a bottom panel and connected thereto two sets of side-by-side adjacent panels running along the full length of at least first and second adjoining edges of said bottom panel, each set of said adjacent panels being deparated by a fold line to form side and top surfaces respectively after said blank is folded, said corner construction comprising first, second and third side-by-side corner panels, said first corner panel attached to one of the adjacent panels which forms said top surfaces of said two sets of adjacent panels, one edge of each of said first and second side-by-side corner panels being defined by fold and cut lines aligned with approximately a center portion of the width dimension of one of said two adjacent panels which forms side side surfaces and which is connected to the bottom panel at said first adjoining edge, an edge of the third one of said corner panels corresponding to said one edge being defined by a cut line which is approximately aligned with said fold line separating said first set of said adjacent panels, said first and second corner panels being separated by a mutual fold line perpendicular to said one edge, said mutual fold line being approximately in line with a fold line separating the other of said sets of two adjacent panels, the second and third of said three corner panels being joined by a fold line which parallel with said mutual fold line, said parallel fold line being offset from said second edge toward a center portion of an inside one of said second adjoning set of adjacent panels which forms said side surface and the third of said three side-by-side panels being joined by a fold line to an outside one of said first set of adjacent panels which forms said top surface, said last named fold line being offset from said second adjoining edge toward the center of said bottom panel.

9. The corner construction of claim 8 wherein a cut-out area separates an end of the inside one of said first set of adjacent panels which forms said side surface and said one edge.

10. The corner construction of claim 8 wherein said bottom is a rectangular panel and there are three of said side-by-side panels at each of the four corners of said rectangular panels.

11. The corner construction of claim 8 and a cut line in the center of the fold line separating said first two sets of said adjacent panels, said cut line being offset from said last named fold line so that when folded two projecting tabs are formed at said corner to protect said box from an impact.

* * * * *